US009047850B1

(12) United States Patent
Beaty

(10) Patent No.: US 9,047,850 B1
(45) Date of Patent: Jun. 2, 2015

(54) ELECTRIC INSTRUMENT MUSIC CONTROL DEVICE WITH MAGNETIC DISPLACEMENT SENSORS

(76) Inventor: David Wiley Beaty, Mesa, AZ (US)

( * ) Notice: Subject to any disclaimer, the term of this patent is extended or adjusted under 35 U.S.C. 154(b) by 106 days.

(21) Appl. No.: 13/536,735

(22) Filed: Jun. 28, 2012

Related U.S. Application Data

(63) Continuation-in-part of application No. 12/974,970, filed on Dec. 21, 2010, now Pat. No. 8,217,253, which is a continuation of application No. 12/253,852, filed on Oct. 17, 2008, now Pat. No. 7,923,623.

(60) Provisional application No. 60/980,721, filed on Oct. 17, 2007.

(51) Int. Cl.

| | |
|---|---|
| ***G10H 1/02*** | (2006.01) |
| ***G10H 1/00*** | (2006.01) |
| ***G10H 1/043*** | (2006.01) |

(52) U.S. Cl.
CPC ..... *G10H 1/0091* (2013.01); *G10H 1/043* (2013.01)

(58) Field of Classification Search
CPC ..... G10H 1/0091; G10H 2230/331
USPC ..... 84/701
See application file for complete search history.

(56) References Cited

U.S. PATENT DOCUMENTS

| | | | | |
|---|---|---|---|---|
| 3,558,793 | A * | 1/1971 | Nakada et al. | 84/600 |
| 4,932,261 | A | 6/1990 | Henrion | |
| 5,345,824 | A | 9/1994 | Sherman et al. | |
| 5,392,650 | A | 2/1995 | O'Brien et al. | |
| 5,540,095 | A | 7/1996 | Sherman et al. | |
| 5,635,739 | A | 6/1997 | Grieff et al. | |
| 5,835,077 | A | 11/1998 | Dao et al. | |
| 5,962,784 | A | 10/1999 | Hulsing, II | |
| 5,974,879 | A | 11/1999 | Hulsing, II | |
| 5,992,233 | A | 11/1999 | Clark | |
| 6,295,870 | B1 | 10/2001 | Hulsing, II | |
| 6,463,802 | B2 | 10/2002 | Hulsing, II | |
| 6,474,160 | B1 | 11/2002 | Stewart et al. | |
| 6,516,283 | B2 | 2/2003 | McCall et al. | |
| 6,522,992 | B1 | 2/2003 | McCall et al. | |
| 6,557,415 | B2 | 5/2003 | Stewart et al. | |
| 6,701,788 | B2 | 3/2004 | Babala | |
| 6,703,939 | B2 | 3/2004 | Lehrman et al. | |
| 6,713,829 | B1 | 3/2004 | Karpman | |
| 6,725,719 | B2 | 4/2004 | Cardarelli | |
| 6,765,489 | B1 | 7/2004 | Ketelhohn | |
| 6,843,126 | B2 | 1/2005 | Hulsing, II | |
| 6,848,304 | B2 | 2/2005 | Geen | |
| 6,868,726 | B2 | 3/2005 | Lemkin et al. | |
| 6,925,876 | B2 | 8/2005 | Babala | |
| 7,069,785 | B2 | 7/2006 | Chou | |

(Continued)

*Primary Examiner* — Jianchun Qin
(74) *Attorney, Agent, or Firm* — Schmeiser, Olsen & Watts LLP

(57) ABSTRACT

An electric instrument music control device is provided having a foot pedal. The foot pedal includes a base portion and a treadle, wherein the treadle moves with respect to the base portion. The device further has a magnetic displacement sensor coupled to the base portion and a magnet coupled to the treadle. The magnet is located adjacent the magnetic displacement sensor to place the sensor in a field-saturated mode, wherein the magnet moves with respect to the magnetic displacement sensor in response to movement of the treadle with respect to the base portion. A sound characteristic of the electric instrument is modified in response to moving the magnet with respect to the magnetic displacement sensor.

16 Claims, 21 Drawing Sheets

(56) References Cited

U.S. PATENT DOCUMENTS

| | | | | |
|---|---|---|---|---|
| 7,095,331 | B2 | 8/2006 | Lehrman et al. | |
| 7,194,376 | B2 | 3/2007 | Zarabadi | |
| 7,243,542 | B2 | 7/2007 | Hulsing, II | |
| 8,525,015 | B2 * | 9/2013 | Armstrong | 84/746 |
| 2001/0045128 | A1 | 11/2001 | McCall et al. | |
| 2005/0257672 | A1 * | 11/2005 | Arimoto | 84/738 |
| 2006/0156903 | A1 * | 7/2006 | Baird et al. | 84/453 |
| 2006/0169041 | A1 | 8/2006 | Madni et al. | |
| 2006/0272413 | A1 | 12/2006 | Vaganov et al. | |
| 2007/0135739 | A1 | 6/2007 | Halperin et al. | |
| 2007/0146323 | A1 | 6/2007 | Nishikata et al. | |
| 2008/0300055 | A1 | 12/2008 | Lutnick et al. | |
| 2009/0104956 | A1 * | 4/2009 | Kay et al. | 463/7 |
| 2011/0231058 | A1 * | 9/2011 | Hanna et al. | 701/41 |

* cited by examiner

ELECTRIC INSTRUMENT MUSIC CONTROL DEVICE WITH MAGNETIC DISPLACEMENT SENSORS

CROSS REFERENCE TO RELATED APPLICATION

This application is a continuation-in-part of earlier filed U.S. Utility Patent Application to David Beaty entitled "ELECTRIC INSTRUMENT MUSIC CONTROL DEVICE WITH MULTI-AXIS POSITION SENSORS," Ser. No. 12/974,970, now U.S. Pat. No. 8,217,253, filed Dec. 21, 2010, which is a continuation of the earlier U.S. Utility Patent Application to David Beaty entitled "ELECTRIC INSTRUMENT MUSIC CONTROL DEVICE WITH MULTI-AXIS POSITION SENSORS," Ser. No. 12/253,852, filed Oct. 17, 2008, now U.S. Pat. No. 7,923,623, which claims priority to U.S. Provisional Patent Application to David Beaty entitled "ELECTRIC INSTRUMENT MUSIC CONTROL DEVICE WITH MULTI-AXIS POSITION SENSORS," Ser. No. 60/980,721, filed Oct. 17, 2007, the disclosures of which are hereby incorporated entirely herein by reference.

BACKGROUND OF THE INVENTION

1. Technical Field

This invention relates generally to an electric instrument music control device and more particularly to an electric instrument music control device that utilizes magnetic displacement sensors to control various music effects.

2. State of the Art

The use of a pedal to control effects of an electric instrument is often employed by a musician to control effects such as volume, vibrato, tone or other types of music effects of an electric instrument. Conventionally, the method in which musicians control these effects is by use of an effects pedal. A conventional effects pedal is an electronic effects unit typically housed in a chassis used by musicians to modify the sound of their instrument.

These conventional effects pedals sit on the floor and have large on/off switches on top that are activated using the foot. Some pedals, such as volume pedals, employ what is known as an expression pedal, which is manipulated while in operation by rocking a large foot-activated pedal mechanically coupled to a potentiometer in a single back and forth motion. The relative position of the expression pedal thus determines the extent to which the music effect is altered. These effects pedals permit the musician to activate and deactivate effects and/or vary the intensity of effects while playing an electric instrument.

Other conventional effects pedals include pedals that utilize light, wherein the pedal controls the amount of light that is directed to a photo cell or other light level sensing devices, the amount of light corresponding to a change in a music effect or characteristic. Further still, other conventional effects pedals include the use of a micro-controller with a bar code that is changed to effect change in the music characteristic of the instrument.

While these conventional devices control music effects of electric instruments, they have their limitations. For example, conventional effects pedals typically require the musician to use a single pedal or input device to control a single music effect, which means that in order to control volume, vibrato and tone the musician would use multiple pedals. Further, conventional pedals are subject to wear due to the mechanical operation of the potentiometer or the limited life of a light source. Conventional pedals are also limited in their ability to adjust the music effect according to various effects curves and/or with a preferred effect curve of the particular musician. Additionally, the musician needs to dedicate one foot during a performance in order to control these effects during playing of the electric instrument, thereby preventing the use of one foot that may otherwise be used for another purpose such as to generate notes with another particular electric instrument.

Accordingly, there is a need in the field of electric instruments music effects devices for an improved electric music effects device that overcomes the limitations of conventional electric music effects devices.

DISCLOSURE OF THE INVENTION

This invention relates generally to electric instrument music control devices and more particularly to an electric instrument music control device that utilizes multi-axis position sensors to control various music effects.

In some embodiments the music control foot pedal includes a database which stores in a look-up table predetermined functions correlating to a desired music effect. In some embodiments the processor is adapted to compare the music effects signal with the predetermined functions stored in the database and apply the music effect corresponding to the music effects signal. In some embodiments the music control foot pedal includes a drag adjustment device. In some embodiments the music control foot pedal includes a tension adjustment device.

In other embodiments an electric instrument music control device operatively coupled to an electric instrument comprises a foot pedal comprising a base portion and a treadle, wherein the treadle moves with respect to the base portion; a magnetic displacement sensor coupled to the base portion; and a magnet coupled to the treadle, wherein the magnet is located adjacent the magnetic displacement sensor to place the sensor in a field-saturated mode, wherein the magnet moves with respect to the magnetic displacement sensor in response to movement of the treadle with respect to the base portion; and a sound characteristic of the electric instrument is modified in response to moving the magnet with respect to the magnetic displacement sensor. The magnetic displacement sensor in some embodiments is a magnetic angular displacement sensor.

Further other embodiments include an electric instrument music control device operatively coupled to an electric instrument, the device comprising a foot pedal comprising a base portion and a treadle, wherein the treadle moves with respect to the base portion; a first magnetic displacement sensor coupled to the base portion; a first magnet coupled to the treadle. The first magnet is located adjacent the first magnetic displacement sensor to place the first magnetic displacement sensor in a field-saturated mode, wherein the first magnet moves with respect to the first magnetic displacement sensor in response to movement of the treadle with respect to the base portion; and a first sound characteristic of the electric instrument is modified in response to moving the first magnet with respect to the first magnetic displacement sensor. The device further includes a second magnetic displacement sensor coupled to the base portion; a second magnet coupled to the treadle, wherein the second magnet is located adjacent the second magnetic displacement sensor to place the second magnetic displacement sensor in a field-saturated mode, wherein the second magnet moves with respect to the second magnetic displacement sensor in response to movement of the treadle with respect to the base portion; and a second sound characteristic of the electric instrument is modified in response to moving the second magnet with respect to the second magnetic displacement sensor. The first and second magnetic displacement sensors in some embodiments are first and second magnetic angular displacement sensors respectively.

Another embodiment includes a method of using an electric instrument music control device comprising retaining a magnetic angular displacement sensor in a fixed position; locating a magnet adjacent the magnetic angular displacement sensor to place the sensor in a field-saturated mode; moving the magnet with respect to the magnetic angular displacement sensor; and controlling a music effect by moving the magnet with respect to the magnetic angular displacement sensor.

The foregoing and other features and advantages of the present invention will be apparent from the following more detailed description of the particular embodiments of the invention.

BRIEF DESCRIPTION OF THE DRAWINGS

The invention will hereinafter be described in conjunction with the appended drawings where like designations denote like elements, and.

DETAILED DESCRIPTION OF EMBODIMENTS OF THE INVENTION

This invention relates generally to electric instrument music control devices and more particularly to an electric instrument music control device that utilizes magnetic displacement sensors to control various music effects. An electric instrument music control device 10 according to the invention is described, wherein music control device 10 controls one or more than one music characteristic with movement of one of the multi-axis position sensors.

Figure 1:
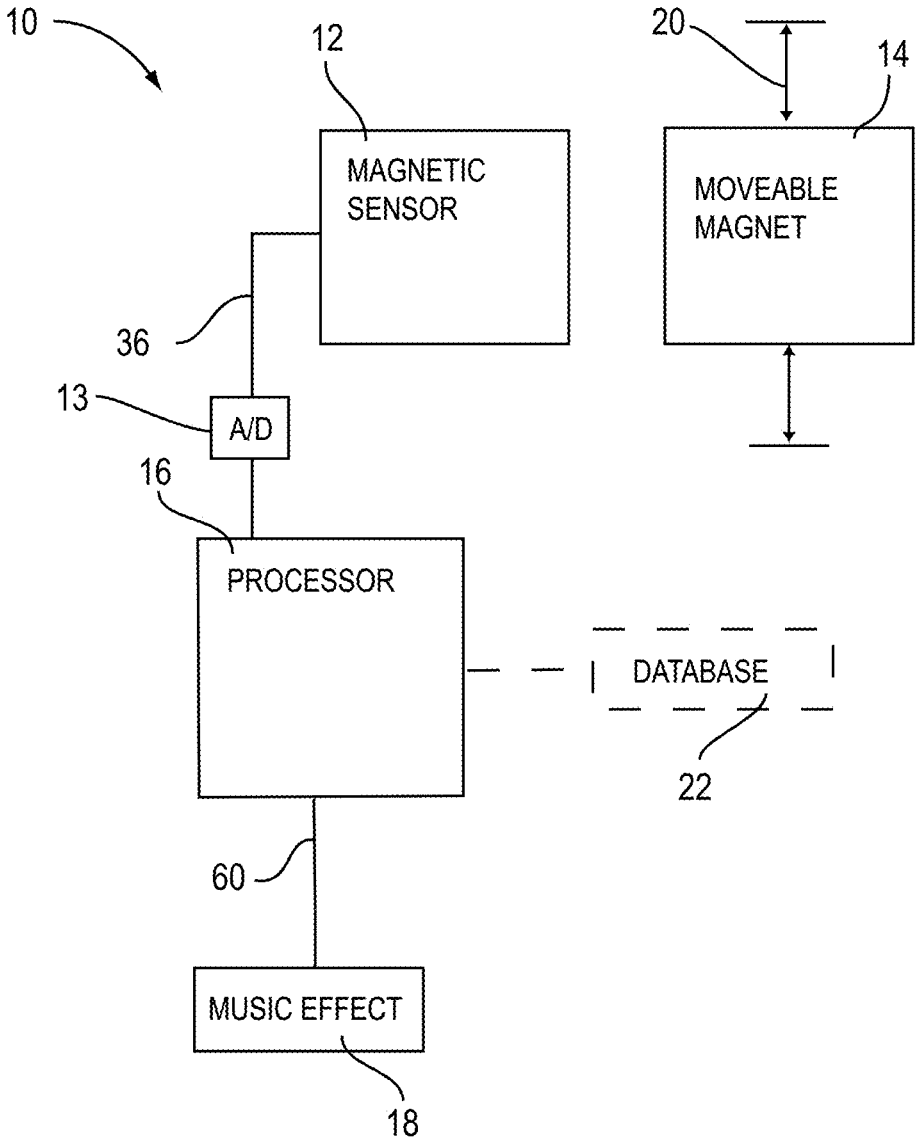
FIG. 1 is a schematic view of one embodiment of music control device 10 in accordance with the invention.

Referring to FIG. 1, electric instrument music control device 10 according to the invention is shown schematically including a magnetic displacement sensor 12 and moveable magnet 14. The magnetic sensor 12 includes signal conditioned voltage outputs, which are all on a single monolithic integrated circuit ("IC"). The magnetic displacement sensor 12 measures the displacement of the magnet 14 with respect to the magnetic displacement sensor 12. In particular, some embodiments of the magnetic displacement sensor 12 is a magnetic angular displacement sensor 12 that measures angular displacement of the magnet 14 with respect to the sensor 12.

The magnetic displacement sensor 12 is a field-saturated sensor 12, wherein the magnet 14 is within a distance 20 such that the magnetic field of the sensor 12 is saturated. The magnetic displacement sensor 12 senses the movement of the magnet 14 due to the affect the movement of the magnet has on the saturate magnetic field of the magnetic displacement sensor 12. The measurement in change by the sensor produces an output signal 36 that is an analog voltage, wherein the signal 36 from sensor 12 is run through an analog-to-digital converter 13 for processor 16 to have the ability to process the signals.

In some embodiments electric music control device 10 includes database 22, which is used to store predetermined functions to be applied by the processor 16 to the input signal 36 to produce music effect signal 60 that is used by the music control device 10 to control music effect 18. Database 22 is not included in all embodiments of electric music control device 10, and so is shown in dotted lines indicating it is an optional component of electric music control device 10.

Figure 2:
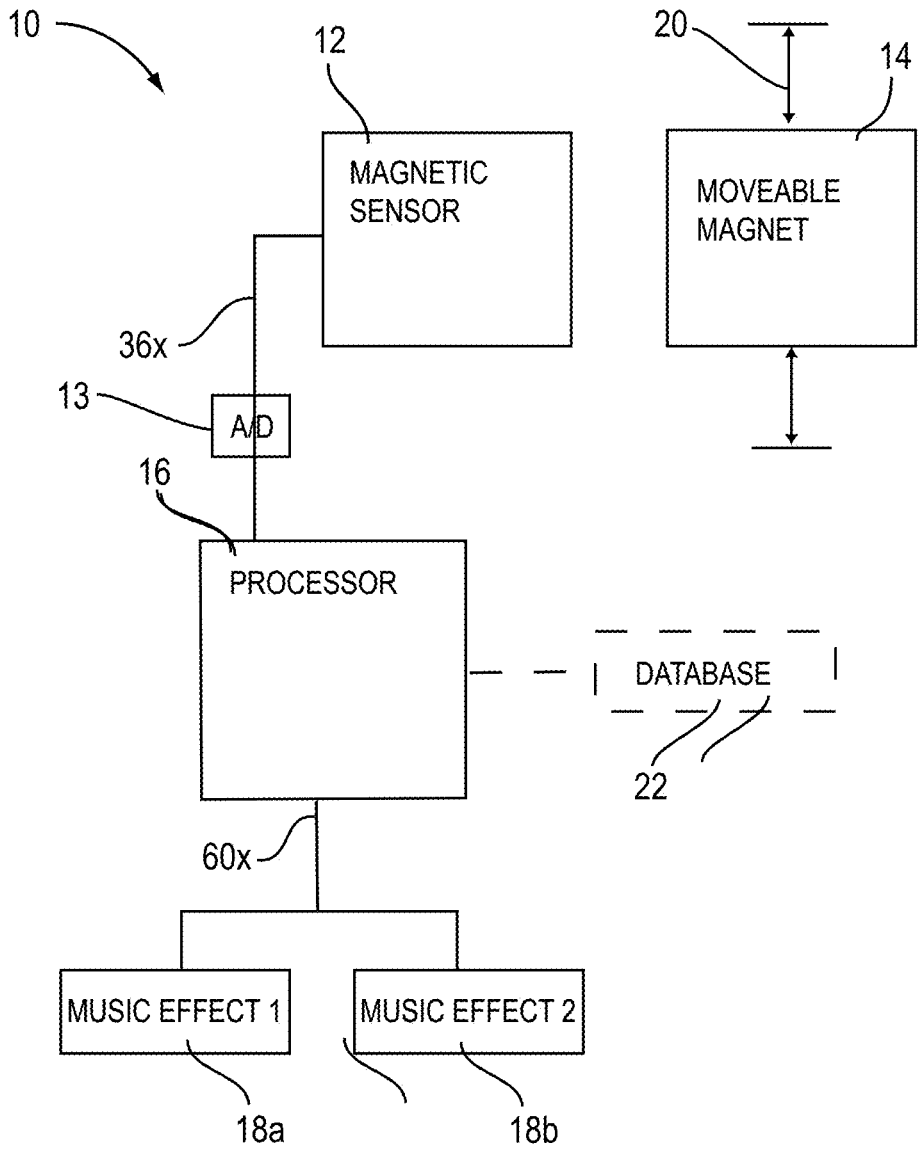
FIG. 2 is a schematic view of another embodiment of music control device 10 according to the invention.

In some embodiments music effect signal 60 is used to control more than one music effect 18, as shown in FIG. 2. FIG. 2 shows an embodiment of music control device 10 where music effect signal 60 is being used to control two different music effects, 18*a* and 18*b*. In this embodiment, magnetic displacement sensor 12 is held fixed and the magnet 14 moves about an X-axis and sends input 36*x* to processor 16. Moveable magnet 14 moves in X-axis 40 and sends output signal 36*x* to processor 16. The processor 16 creates music effect signal 60*x*, which represents the displacement of the magnet 14 about the X-axis. Music effects signal 60*x* is used to control two music effects 18*a* and 18*b*. For example but not by way of limitation, music effects signal 60 can be used to control music effect 18*a* which is volume, and music effect 18*b* which is tone. Music effects 18*a* and 18*b* can be any controllable music effects. In some embodiments music effects signal 60 can be used to control more than two music effects. Controllable music effects 18 include, but are not limited to wah, distortion, pitch, volume, tone, vibrato, tremolo and the like.

Some embodiments of music control device 10 include more than one magnetic displacement sensors 12, with a corresponding moveable magnet 14. Each magnetic displacement sensor 12 with corresponding moveable magnet 14 may then be used to control music effects 18.

Figure 3:
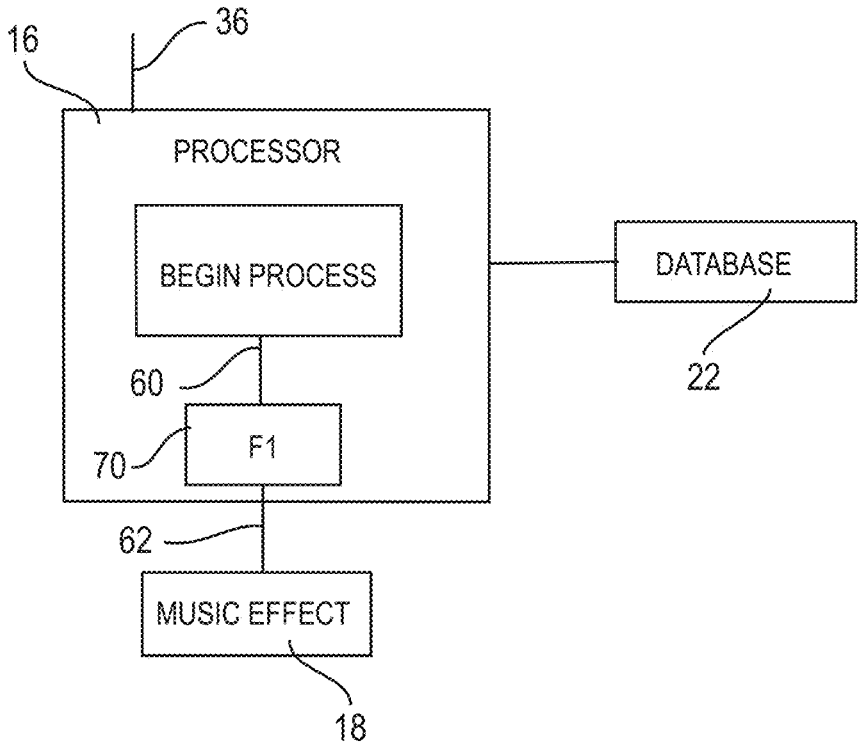
FIG. 3 shows a schematic view of one embodiment of processor 16 which can be used in music control device 10 according to the invention as shown in FIG. 1 and FIG. 2.
Figure 4:
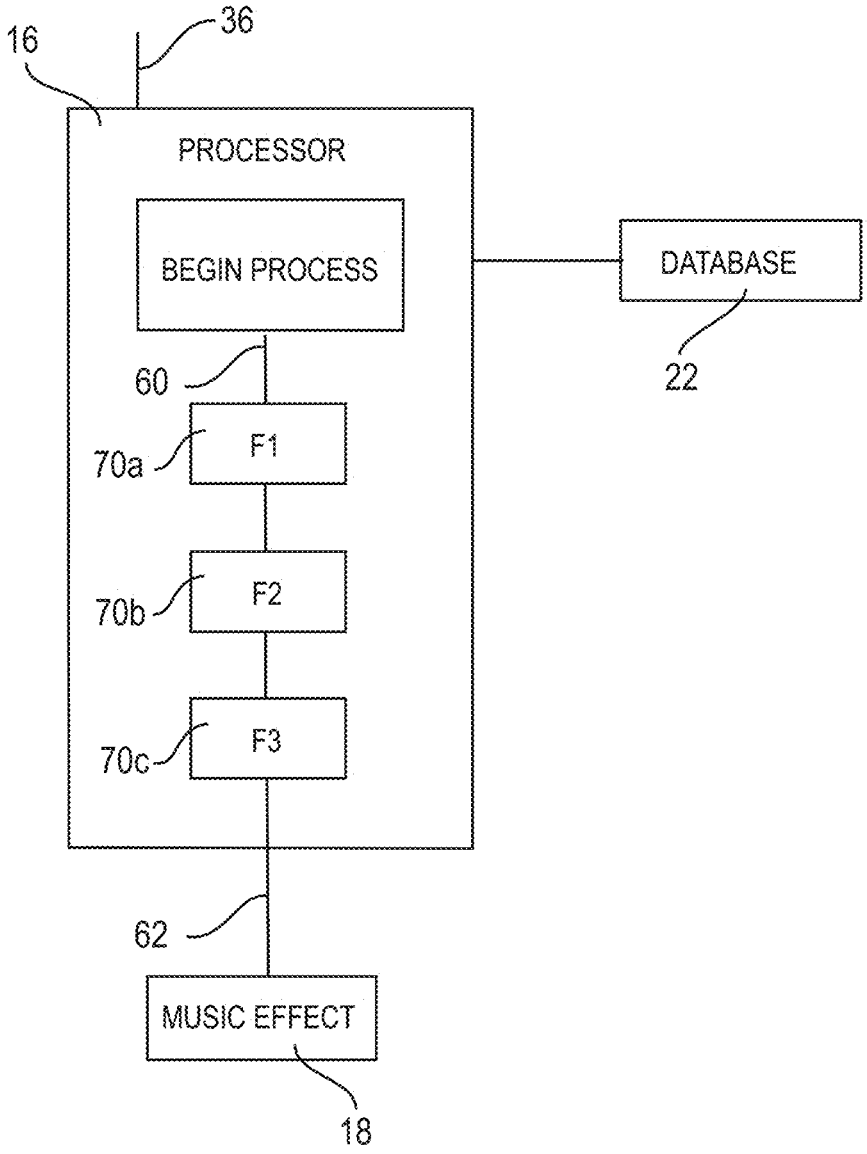
FIG. 4 shows a schematic view of another embodiment of processor 16 which can be used in music control device 10 according to the invention as shown in FIG. 1 and FIG. 2.

In some embodiments of music control device 10, processor 16 includes predetermined functions 70 which can be applied to music effects signal 60 to modify music effect 18. FIG. 3 and FIG. 4 show schematic embodiments of processor 16. In this embodiment processor 16 uses database 22 to store one or more functions 70 correlating to a desired music effect 18. This allows music control device 10 to create music effects signal 60 by applying a predetermined function 70 to music effects signal 60, where predetermined function 70 can represent a change, a rate of change or other music expression that generates or manipulates music effect 18 of the electric instrument.

FIG. 3 shows an embodiment of processor 16 where music effects signal 60 is multiplied by function 70 to create processed music effects signal 62. Processed music effects signal 62 can be used to control one or more than one music effect 18 as discussed previously. In this way processor 16 applies at least one predetermined function 70 to music effects signal 60 to create processed music effects signal 62, where processed music effects signal 62 controls a music effect of an electric instrument.

FIG. 4 shows an embodiment of processor 16 where music effects signal 60 is multiplied by multiple different functions 70 which include function 70*a*, function 70*b*, and function 70*c*. The multiplication of music effects signal 60 by function 70*a*, function 70*b*, and function 70*c* results in processed music effects signal 62, which is used to control music effect 18. In some embodiments music effects signal 60 is multiplied by more than three functions. In some embodiments music effects signal 60 is multiplied by two functions. In this way processor 16 applies more than one predetermined function 70 to music effects signal 60 to create processed music effects signal 62, where processed music effects signal 62 controls a music effect 18 of an electric instrument.

In some embodiments processor 16 is adapted to create music effects signal 60 with functions 70 in database 22. Function 70 can be a look-up table stored in database 22. Function 70 may be multiple look-up tables, each look-up table corresponding to controlling a particular music effect 18.

Predetermined functions 70 can be many different types. In some embodiments function 70 is a polarity reverse function. A polarity reverse function reverses the polarity of music effects signal 60, which has the same effect as when magnet 14 is rotated about the particular axis by 180 degrees. The result of the polarity reverse function is to reverse the polarity of music effect 18. For example, using FIG. 4 to explain, processed music effects signal 62 is controlling music effect 18 where music effect 18 is a volume control. Before function 70 is applied to music effects signal 60, where function 70 is a polarity reverse function, larger angular movement of moveable magnet 14 results in music effect 18 of increasing the volume of the music. After function 70 is applied to music effects signal 60, where function 70 is a polarity reverse function, larger angular movement of moveable magnet 14 results in music effect 18 of decreasing the volume of the music. In this way polarity reverse function 70 reverses the polarity of the music effect 18 controlled by processed music effects signal 62.

In some embodiments function 70 is a minimum signal function. Minimum signal function 70 prevents music effects signal 60 from passing through function 70 until music effects signal 60 reaches a predetermined minimum level, at which point music effects signal 60 is allowed to pass through function 70 and become processed music effects signal 62. The effect of minimum signal function 70 is to prevent movements, noise and vibrations smaller than the predetermined level from passing through function 70 to become music effect 18. Small movements, noise, and vibrations are filtered out by minimum signal function 70, increasing the quality of music from the electric instrument.

In some embodiments function 70 is a fixed gain function. Fixed gain function 70 has the effect of multiplying (or applying) a fixed number to music effects signal 60, wherein the fixed number does not change as the music effects signal changes. This fixed gain function 70 is useful to make processed music effects signal 62 and music effect 18 less sensitive to movement of magnet 14 than music effects signal 60 is. A fixed gain function 70 where the gain is a number greater than one will make processed music effects signal 62 and music effect 18 more sensitive to movement of magnet 14 than music effects signal 60 is.

In some embodiments function 70 is a variable gain function. Variable gain function 70 will apply a numeric gain value to music effects signal 60 to create processed music effects signal 62 where the numeric gain value varies in some predetermined manner across the range of angular movement. The manner in which variable gain function 70 varies versus angle can be stored in a look-up table as discussed earlier. Or variable gain function 70 can be stored as a numeric equation. These variable gain functions 70 are often called tapers by musicians. Taper functions are used to match different music control devices, or to obtain a specific effect by changing a music effect 18 in a specific way over angular movement. As discussed earlier, processor 16 uses database 22 to store multiple variable gain functions 70 for use as needed.

Figure 5:
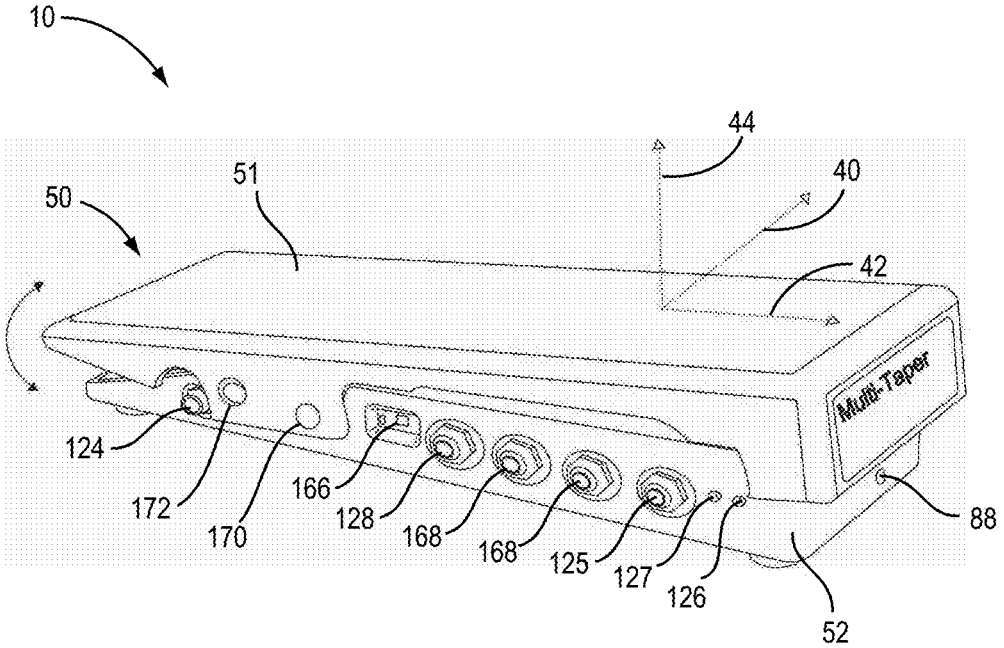
FIG. 5 shows a perspective view of music control device 10 embodied as music control foot pedal 50 according to the invention.
Figure 6:
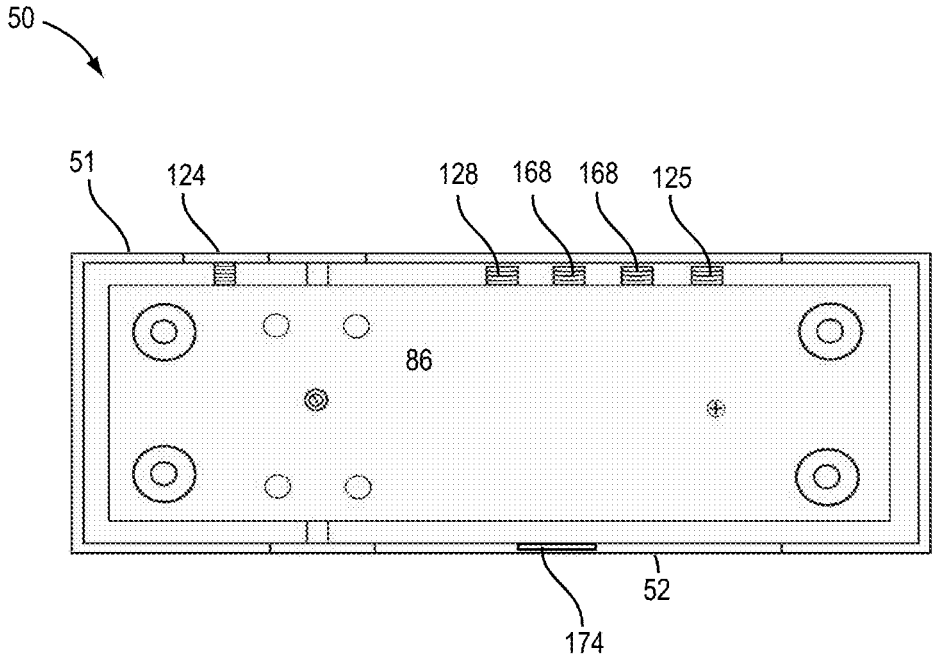
FIG. 6 shows a bottom view of music control foot pedal 50 of FIG. 6.
Figure 7:
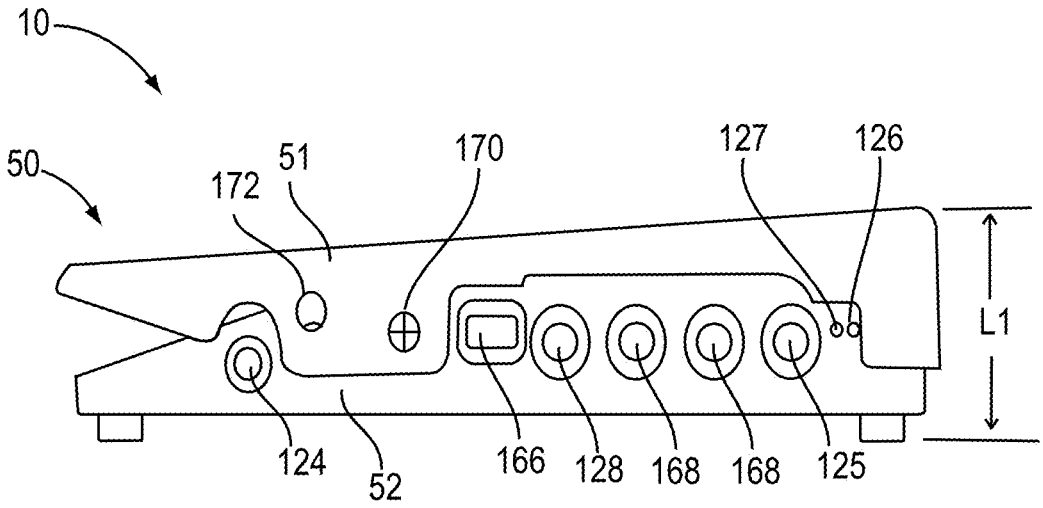
FIG. 7 shows a side view of music control foot pedal 50 of FIG. 5 in toe down condition.
Figure 8:
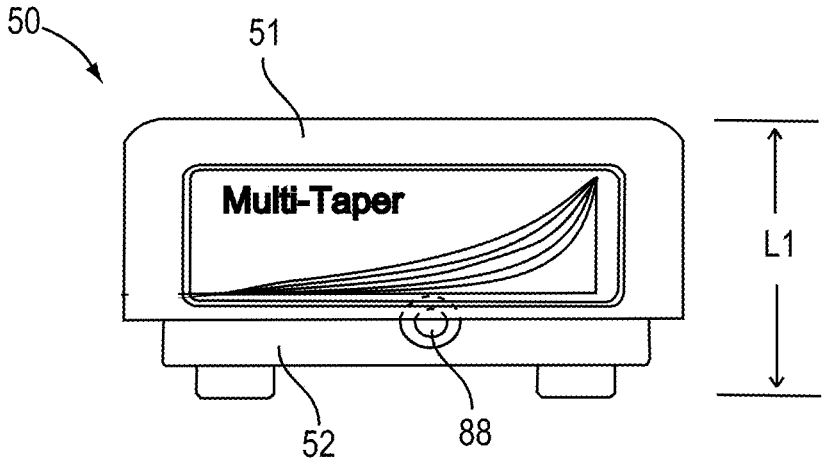
FIG. 8 shows a front view of music control foot pedal 50 of FIG. 5 in a toe down condition.
Figure 9:
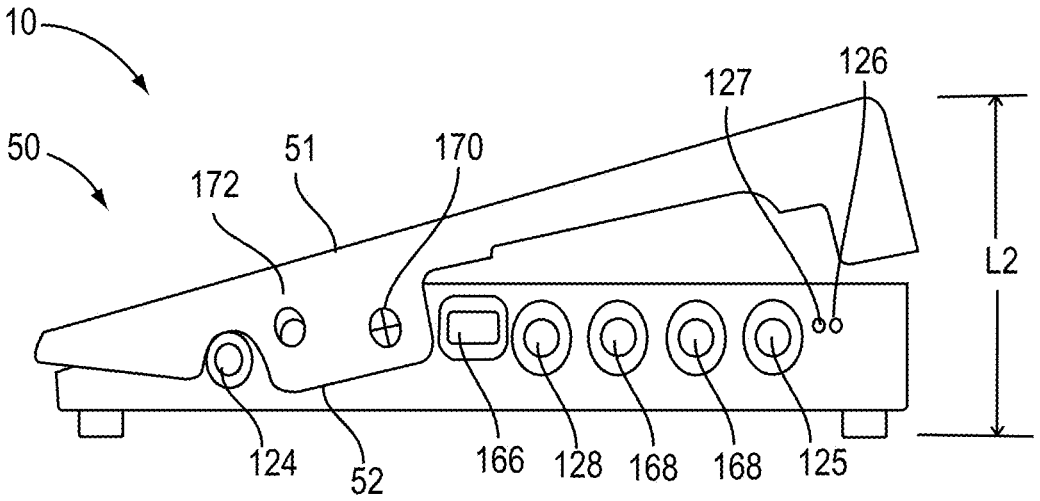
FIG. 9 shows a side view of music control foot pedal 50 of FIG. 5 in a heel down condition.
Figure 10:
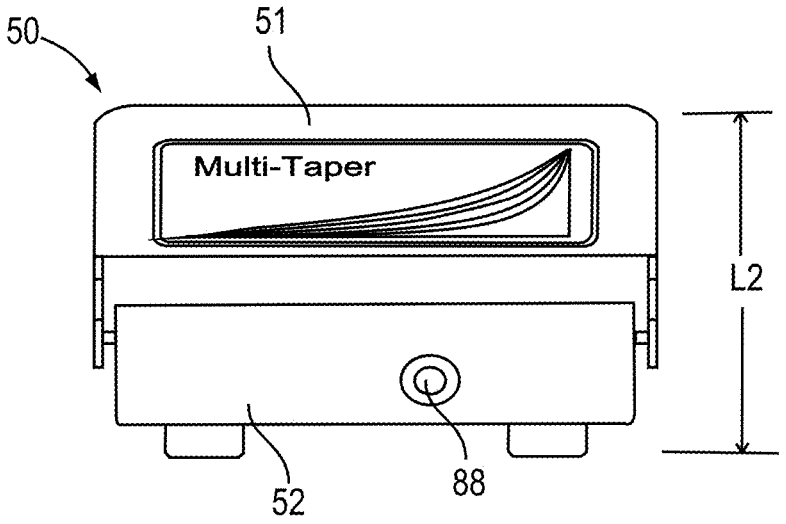
FIG. 10 shows a front view of music control foot pedal 50 of FIG. 5 in a heel down condition.

Referring now to FIG. 5 through FIG. 10, electric instrument music control device 10 takes the form of foot pedal 50, wherein foot pedal 50 has treadle 51 which is rotatable about at least one axis. FIG. 5 shows a perspective view of electric music control foot pedal 50 according to the invention. FIG. 6 shows a bottom view of electric music control foot pedal 50 of FIG. 5. FIG. 7 shows a side view of electric music control foot pedal 50 of FIG. 5 with electric music control foot pedal 50 in the toe down condition. FIG. 8 shows a front view of electric music control foot pedal 50 of FIG. 5 with electric music control foot pedal 50 in the toe down condition. FIG. 9 shows a side view of electric music control foot pedal 50 of FIG. 5 with electric music control foot pedal 50 in the heel down condition. FIG. 10 shows a front view of electric music control foot pedal 50 of FIG. 5 with electric music control foot pedal 50 in the heel down condition. Foot pedal 50 includes base portion 52 and treadle 51. Base portion 52 supports treadle 51 and a rotation mechanism that allows treadle 51 to be rotated about at least one axis by applying force on treadle 51 corresponding to rotation about the at least one axis 170 or 172. Axis 170 is a forward axis, while axis 172 is back axis. Either axis 170 or 172 may be used as preferred by the user. Base portion 52 retains magnetic displacement sensor 12 in a fixed position as explained earlier with regard to FIG. 1 through FIG. 5. Treadle 51 retains moveable magnet 14 as explained with regard to FIG. 1 through FIG. 5. As treadle 51 is rotated about an axis, moveable magnet 14 is also rotated about the axis. Magnetic displacement sensor 12 is in communication with processor 16 in base portion 52. Music effects signal 60 produces a desired change in a music effect 18. Magnetic displacement sensor 12 communicate with processor 16 in some embodiments through a wired connection. In some embodiments, wireless communication between reference and magnetic displacement sensor 12 and processor 16 is used, such as a Bluetooth™ communication, infra red or other wireless communication.

Electric music control foot pedal 50 can move between two mechanical positions—a heel down condition and a toe down condition. In the toe down condition a front end of treadle 51 is positioned a distance L1 from the bottom of base portion 52. In the heel down condition a front end of treadle 51 is positioned a distance L2 from the bottom of base portion 52. Distance L2 is larger than distance L1 so the front end of treadle 51 of electric music control foot pedal 50 in the heel down condition is higher off of base portion 52 than it is in the toe down condition, as shown in FIG. 7 through FIG. 10.

Further, the present invention in some embodiments has the ability to use either a forward axis 170 or a back axis 172 to alter the range of motion a user's foot as the treadle 51 travels between the toe down condition and the heel down condition. This is particularly helpful to a user that may from time to time wear footwear that includes a higher heel or a flat sole. Accordingly, having selectability of which axis to use provides a mechanical customizability for the user.

Magnetic displacement sensor 12, processor 16, and in some embodiments database 22 in base portion 52 of foot pedal 50 have all the capabilities and uses as explained with respect to music device 10 shown in FIG. 1 through FIG. 4. In some embodiments database 22 is used to store predetermined functions 70 which can be applied to music effects signal 60 prior to creating music effects 18.

Electric music control foot pedal 50 of FIG. 5 through FIG. 10 includes power input port 124. Power input port 124 in this embodiment accepts power for sensors 12 and 14, processor 16, database 22, and all other circuitry associated with electric music control foot pedal 50.

Electric music control foot pedal 50 in this embodiment also includes taper switch 166. Taper switch 166 is used for choosing which function 70 is to be applied to music effects signal 60. In this embodiment taper switch 166 is a ten-position switch, allowing one of ten different tapers, or variable gain functions, to be chosen and applied to music effects signal 60 as explained earlier with regard to FIG. 3 through FIG. 4.

Input jack 125 of electric music control foot pedal 50 accepts both high and low impedance inputs signals, and both balanced and unbalanced input signals. Input jack 125 accepts unbalanced high impedance sources. Input jack 125 also accepts both high and low impedance balanced sources. The circuitry of electric music control foot pedal 50 detects whether the input is balanced or unbalanced and requires no switching. In some embodiments foot pedal input jack 125 will accept both monaural and stereo input source signals.

Electric music control foot pedal 50 as shown in FIG. 5 through FIG. 10 includes output jacks 168. Output jacks 168 supply output signal 60 or 62, depending on whether functions 70 are used or not. In some embodiments where foot pedal 50 is supplying monaural outputs, the signals from the two output jacks 168 are identical. In some embodiments where foot pedal 50 is supplying stereo output signals, the two output jacks 168 provide the left and right stereo output signals.

Figure 17A:
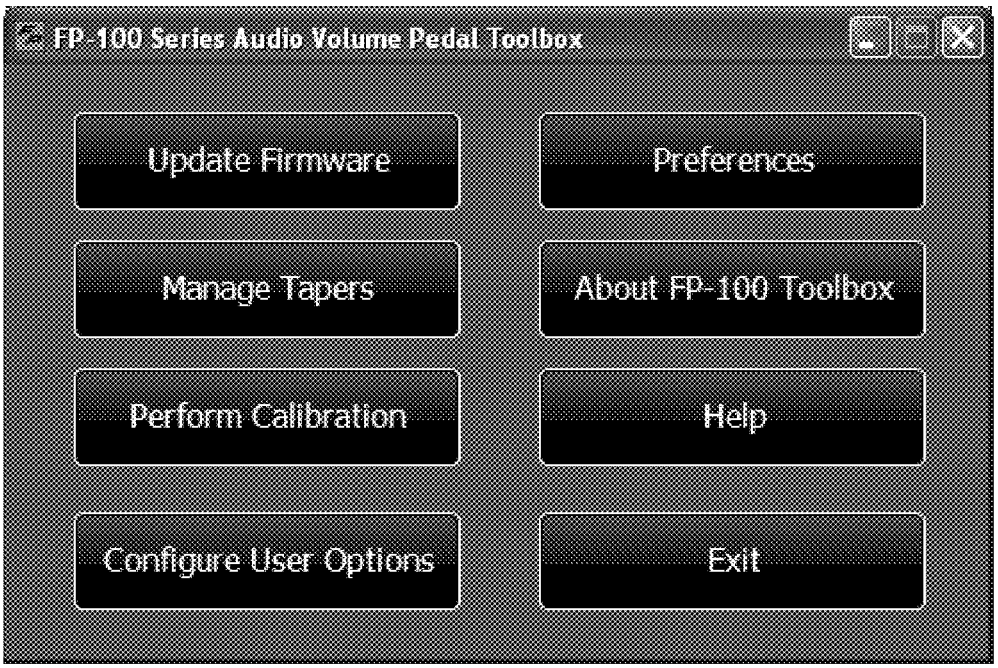
FIG. 17 depicts various user interface screens.
Figure 17B:
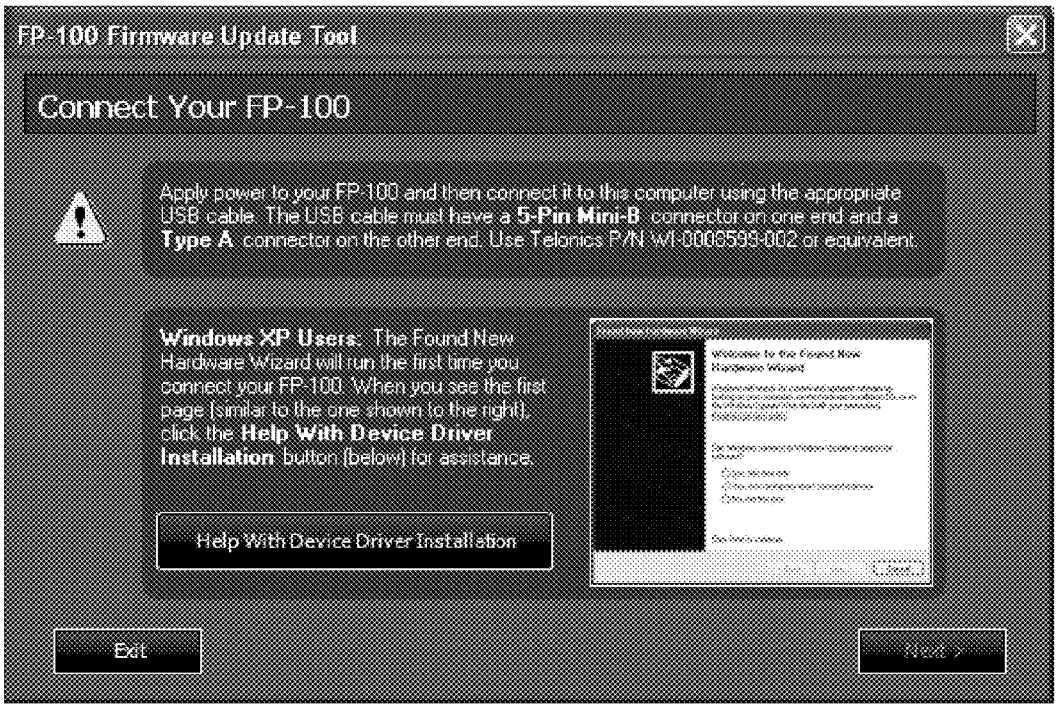
Figure 17C:
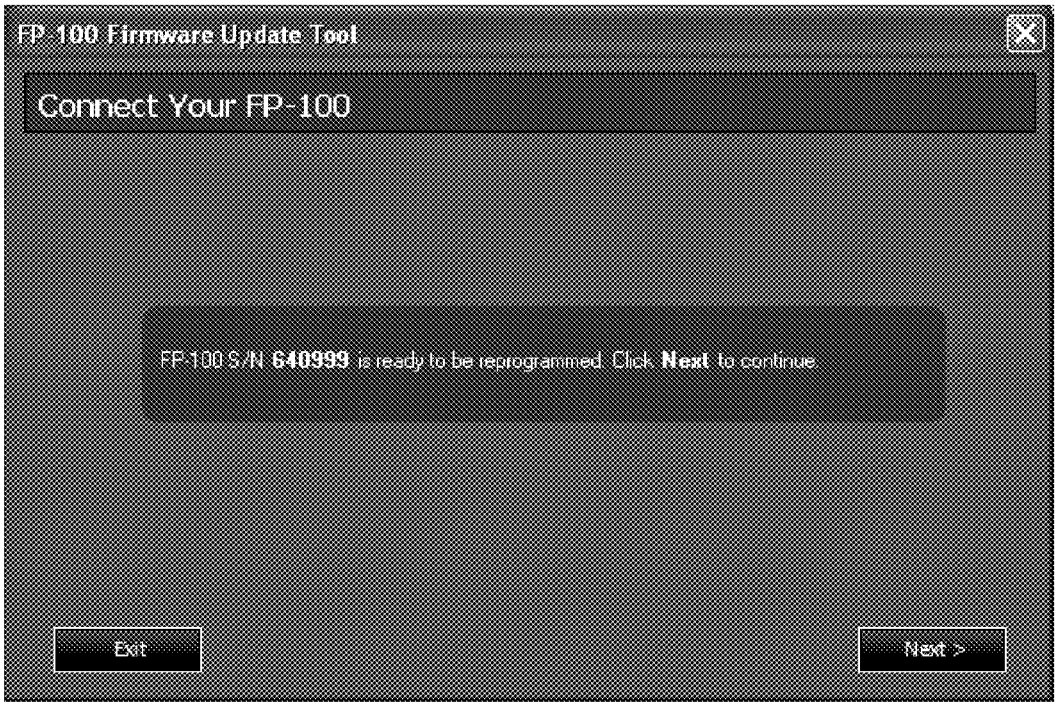
Figure 17D:
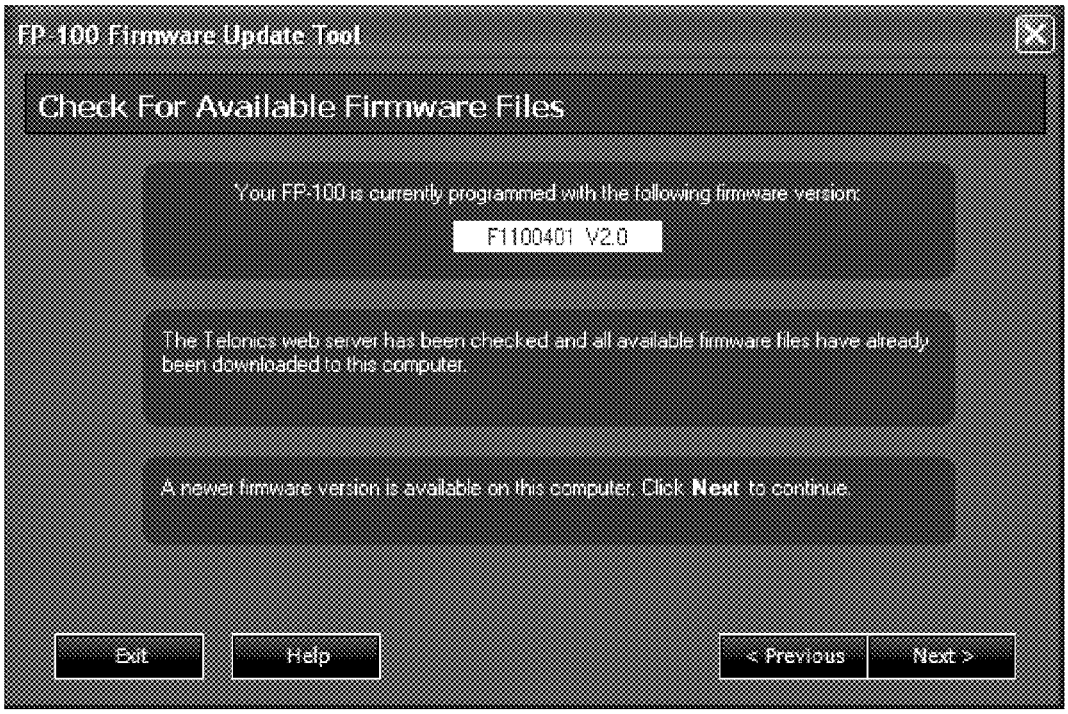
Figure 17E:
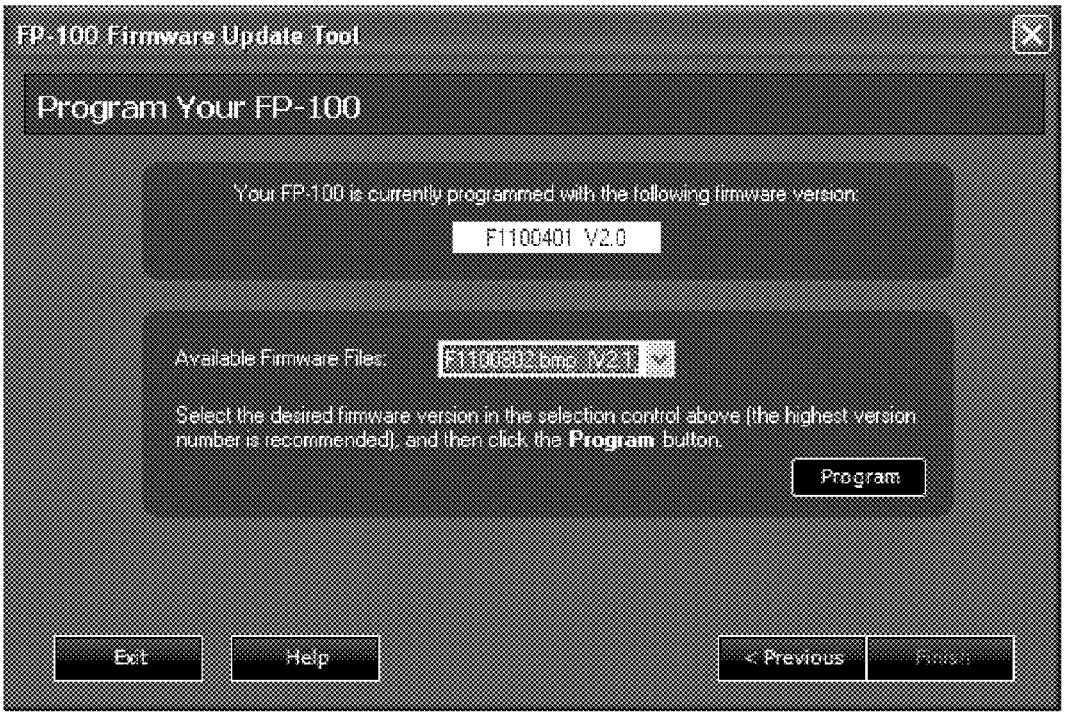
Figure 17F:
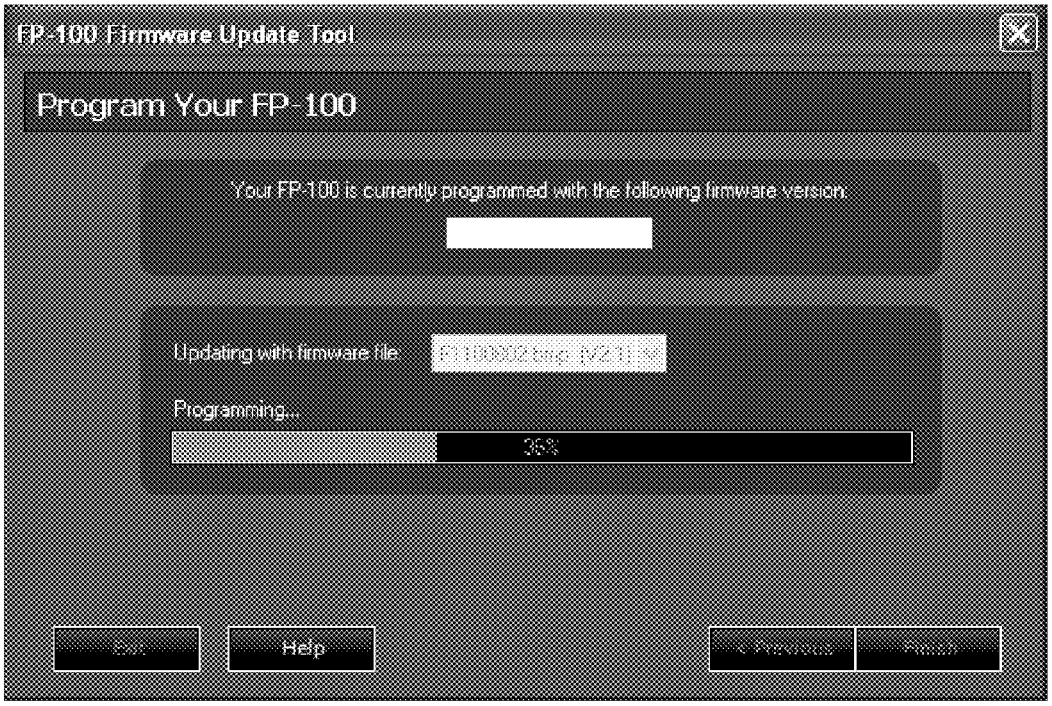
Figure 17G:
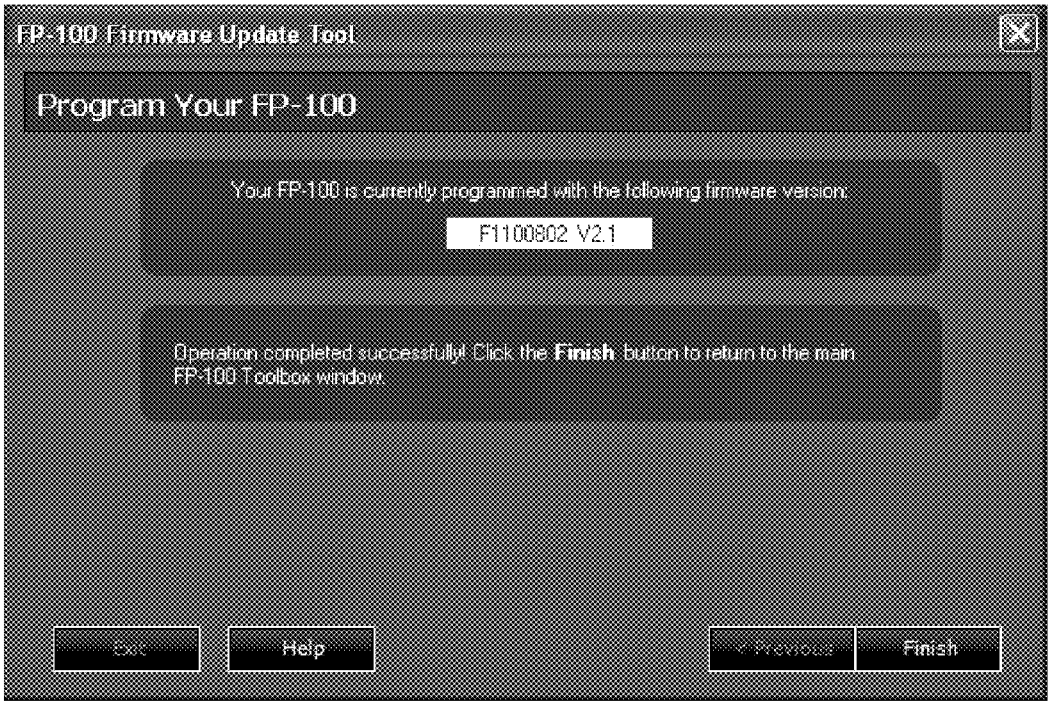
Figure 17H:
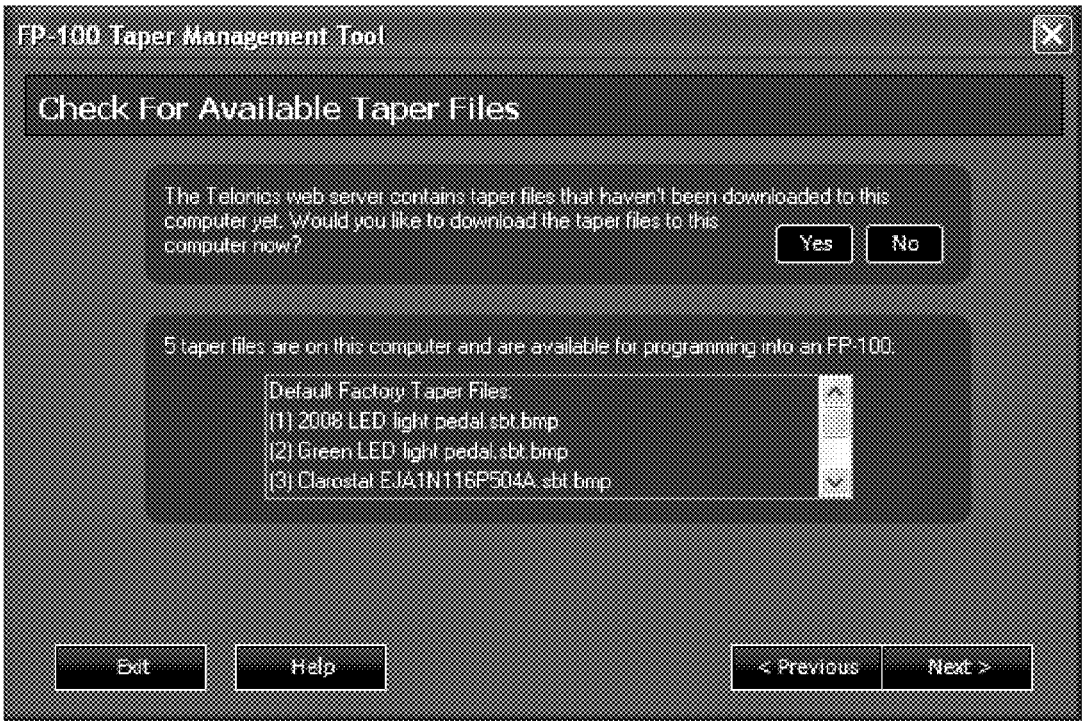
Figure 17I:
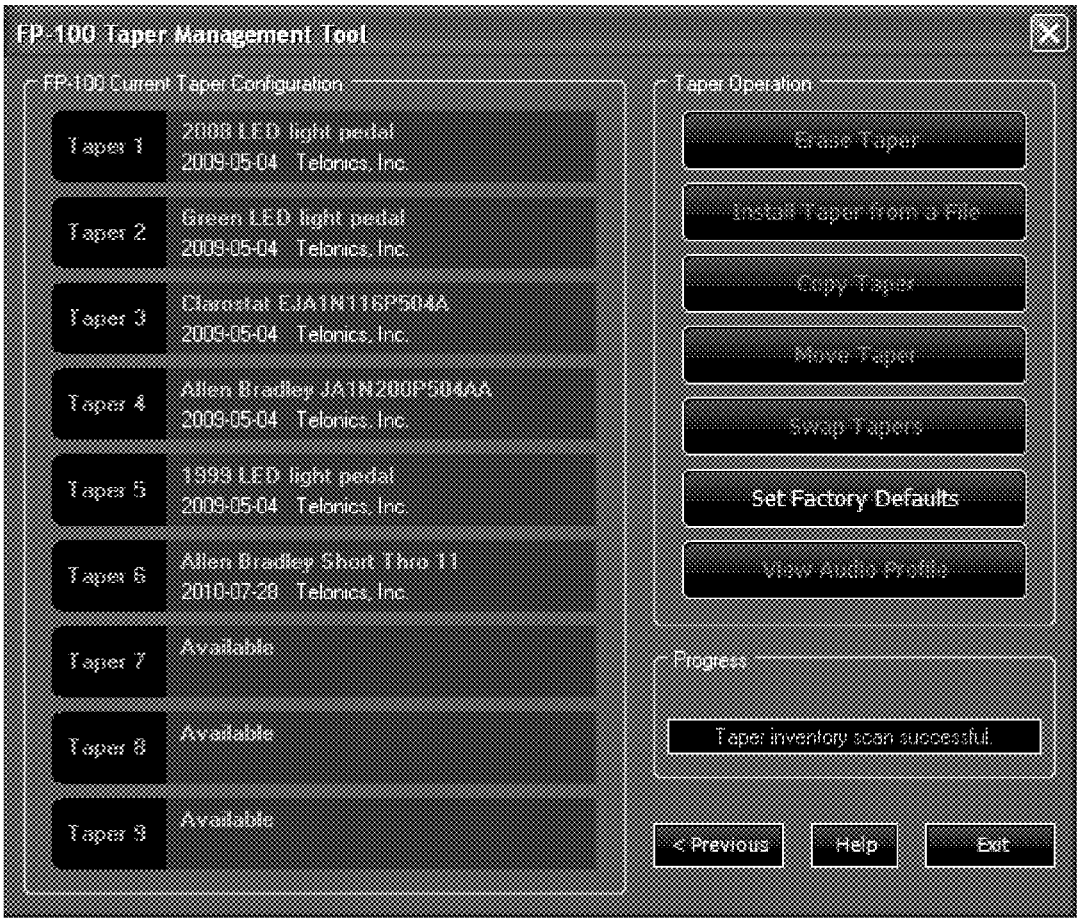
Figure 17J:
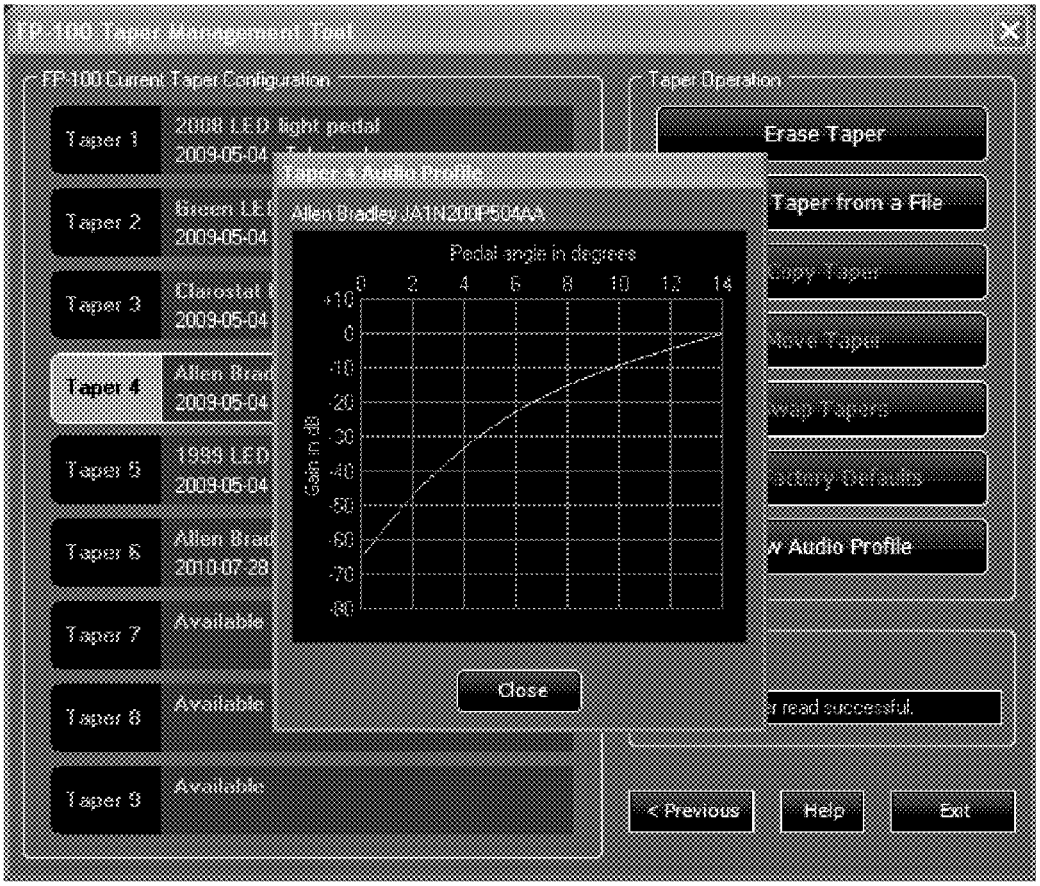
Figure 17K:
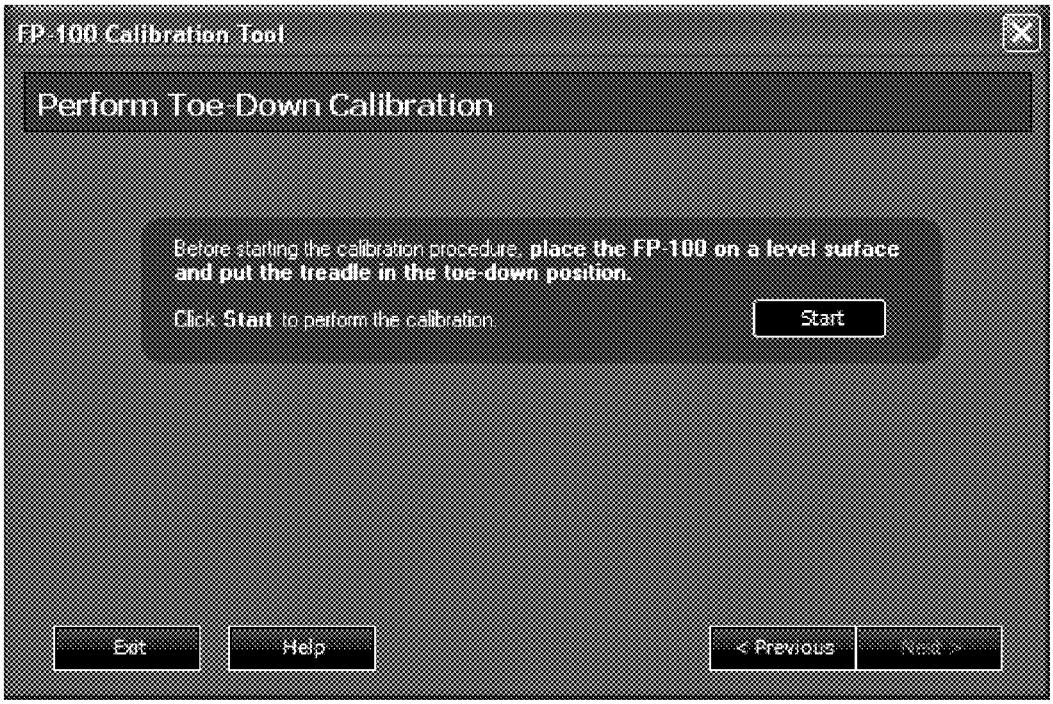
Figure 17L:
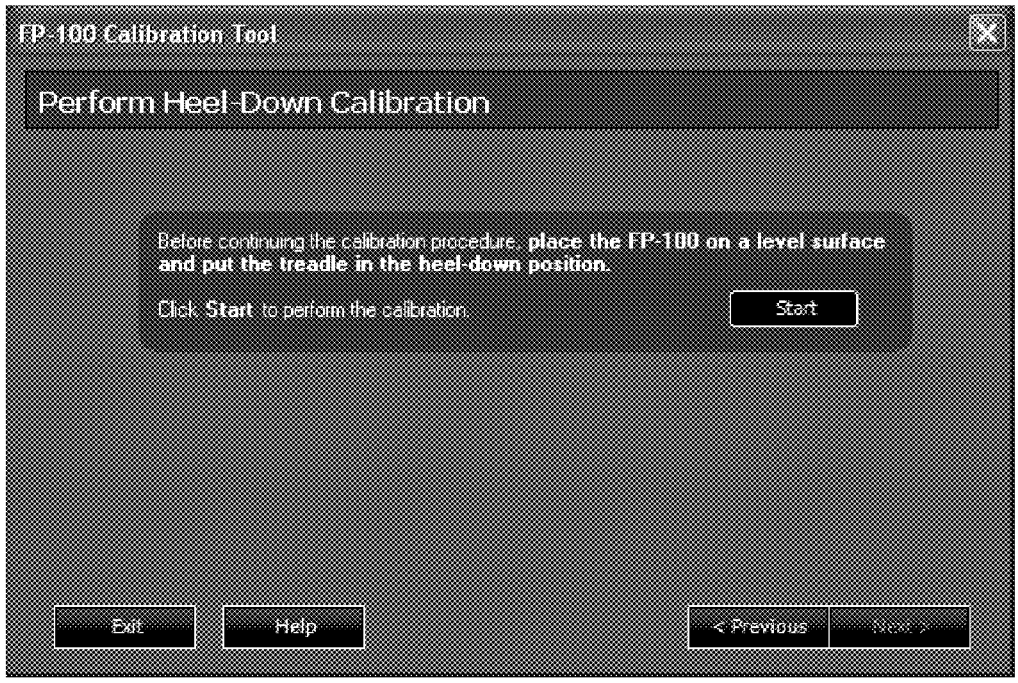
Figure 17M:
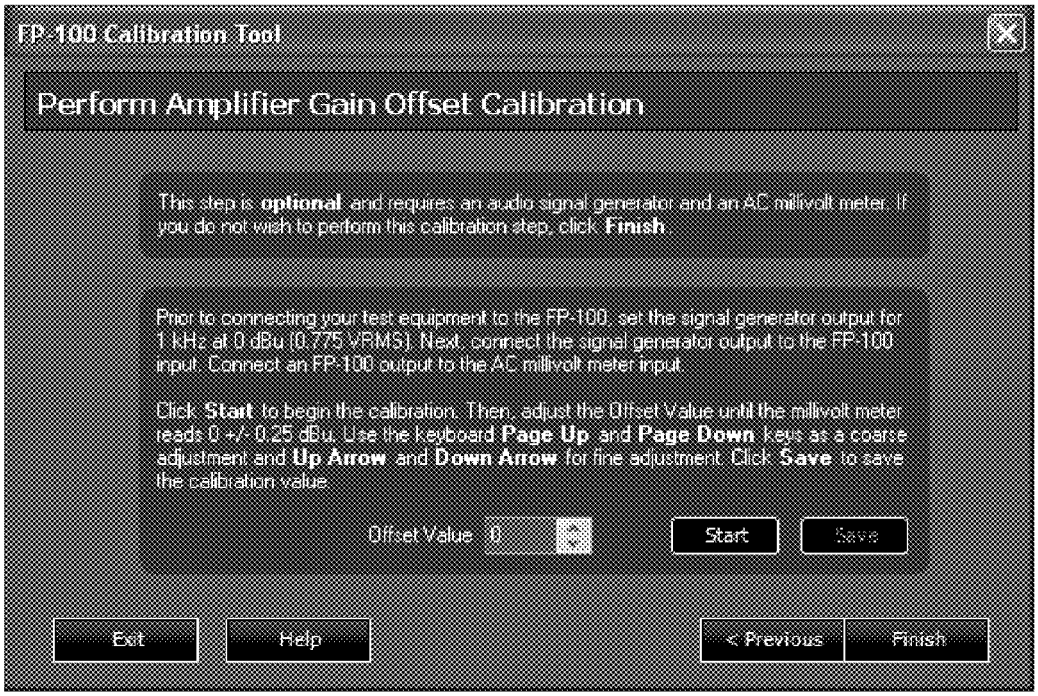
Figure 17N:
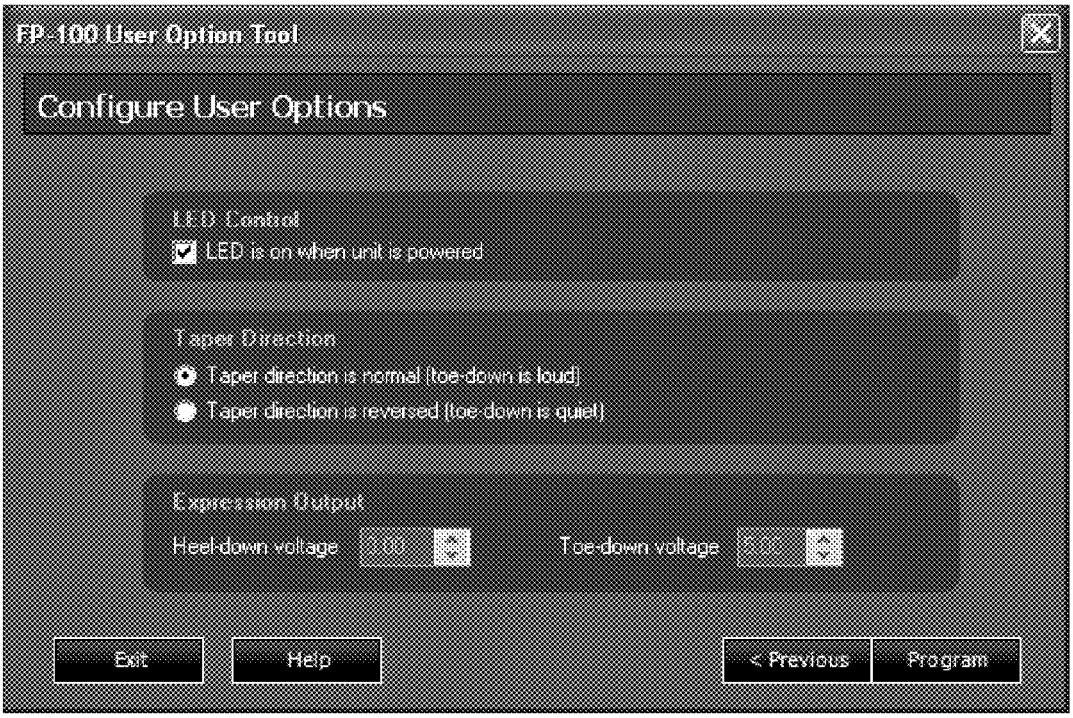

Electric music control foot pedal 50 as shown in FIG. 5 through FIG. 10 includes USB port 174, wherein the USB port 174 provides for the connection of the pedal 50 with a computer (not shown). The computer operates a software application that configures the pedal 50. For example, the software application controls the tapers, which is a mathematical function of the manner in which the gain of the musical signal is controlled as a function of treadle 51 movement. The software application allows for manipulation and storage of various tapers for particular music effects. The software application also allows for the uploading of the desired tapers to the pedal 50. The software application provides user interface screen on the computer. Examples of various user interface screens are provided in FIG. 17A through FIG. 17N. These user interfaces allow a user to configure a foot pedal 50 that is connected to the computer through USB port 174. Additionally, the software application may be used to update the firmware of the pedal 50 through USB port 174.

Input impedance adjust device 127 is used to adjust the input impedance of the input amplifier of foot pedal 50 of FIG. 5 through FIG. 10. In this embodiment input impedance adjustment device 127 is a set-screw. In some embodiments other input impedance adjustment means are used.

Electric music control foot pedal 50 as shown in FIG. 5 through FIG. 10 includes tuner/sensor jack 128. In this embodiment, jack 128 of electric music control foot pedal 50 has dual uses and is always on regardless of treadle 51 position. Jack 128 provides a tuner output signal which allows the user to continuously monitor tuning with pedal 50 in any position, including the full/minimum off position.

Electric music control foot pedal 50 as shown in FIG. 5 through FIG. 10 includes minimum ON adjustment device 126. Minimum ON adjustment device 126 is used to adjust the minimum signal level when one of the predetermined functions applied to music effects signal 60 is a minimum signal level function 70, as discussed earlier. This adjustment controls the minimum level of audio which is allowed to pass through processor 16 when treadle 51 is in the minimum sound level position. In this embodiment minimum ON adjustment device 126 is a set screw. Turning minimum ON adjustment device 126 in one direction raises the signal level that must be reached in order to pass through processor 16. Turning minimum ON adjustment device 126 in the opposite direction lowers the signal level that must be reached in order to pass through processor 16. After adjustments are made, embodiments of the present invention provide for an auto store function, wherein after a predetermined period of time, such as 10 seconds, the adjustments are automatically stored and written to an onboard memory. Further, these adjustments may be associated with specific tapers.

In some embodiment foot pedal 50 includes tension adjust device 88. In the embodiment shown in FIG. 5 through FIG. 10, tension adjust device 88 is a set screw which adjusts the tension of treadle 51 by rotation of tension adjust device 88. Tension adjust device 88 can be any mechanical adjustment device which can adjust the tension of treadle 51. Adjusting the tension of treadle 51 means adjusting the pedal return force, which is the force it takes for treadle 51 to return to a heel down (nominal) position after all forces applied to treadle 51 are removed. The tension adjust device 88 includes a reference position that requires a reference pedal return force to return the treadle 51 to nominal position after all force on treadle 51 are removed. Adjusting tension device 88 to increased tension means that treadle 51 takes a greater force than the reference pedal return force to return to nominal position after all forces on treadle 51 are removed, in other words the pedal return force is increased. Adjusting tension device 88 to decreased tension means that treadle 51 takes a lesser force than the reference pedal return force to return to nominal position after all forces on treadle 51 are removed, in other words the pedal return force is decreased. In this way foot pedal 50 includes tension adjust device 88, wherein the pedal return force changes in response to adjusting tension adjust device 88.

In some embodiments foot pedal 50 includes drag adjustment device 86 or a braking device. FIG. 6 shows an embodiment of drag adjustment device 86 as a set screw which can be rotated to increase or decrease drag on treadle 51. Drag is a measure of how easy or difficult treadle 51 moves. Adjusting the drag of treadle 51 means adjusting how easy or difficult it is to move treadle 51 and movable magnet 14 retained in treadle 51. Rotating drag adjustment device 86 in one direction increases the ease of movement of treadle 51. Rotating drag adjustment device 86 in the other direction decreases the ease of movement of treadle 51. Increasing the ease of movement of treadle 51 means making treadle 51 easier to move in the one or more than one axes of movement measured by magnetic displacement sensor 12. Decreasing the ease of movement of treadle 51 means making treadle 51 more difficult to move in the one or more than one axes of movement measured by magnetic displacement sensor 14. Adjusting drag adjustment device 86 changes the ease of movement of treadle 51. In this way foot pedal 50 includes drag adjustment device 86, wherein the ease of movement of treadle 51 is changed in response to adjusting drag adjustment device 86.

With reference to FIG. 5 through FIG. 10 and FIG. 11 through FIG. 15, embodiments of an electric instrument music control device include a foot pedal 10 comprising a base portion 52 and a treadle 51, wherein the treadle 51 moves with respect to the base portion 52. The device further includes a magnetic displacement sensor 220 coupled to the base portion 52 and a magnet 222 coupled to the treadle 51. The magnet 222 is located adjacent the magnetic displacement sensor 220 to place the sensor 220 in a field-saturated mode, wherein the magnet 222 moves with respect to the magnetic displacement sensor 220 in response to movement of the treadle 51 with respect to the base portion 52. Further, a sound characteristic of the electric instrument is modified in response to moving the magnet 222 with respect to the magnetic displacement sensor 220. It will be understood that in some embodiments, the magnetic displacement sensor 220 is a magnetic angular displacement sensor.

Figure 11:
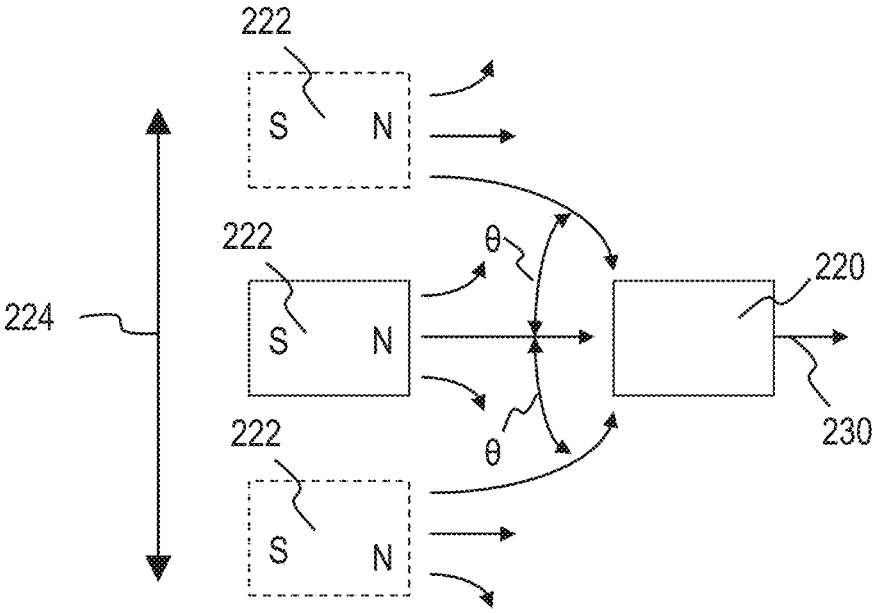
FIG. 11 shows a schematic view of a magnetic displacement sensor with a moveable magnet.
Figure 12:
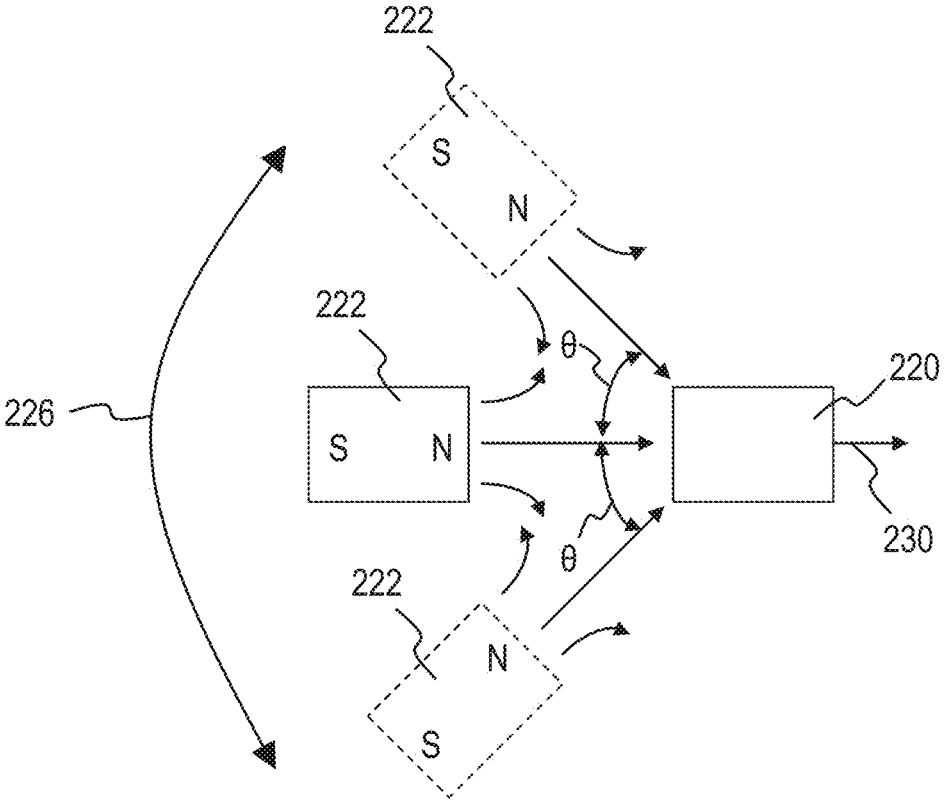
FIG. 12 shows a schematic view of a magnetic angular displacement sensor with a moveable magnet.
Figure 14:
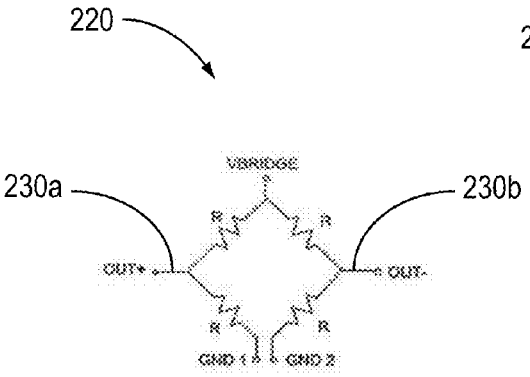
FIG. 14 is a schematic view of a magnetic sensor.
Figure 15:
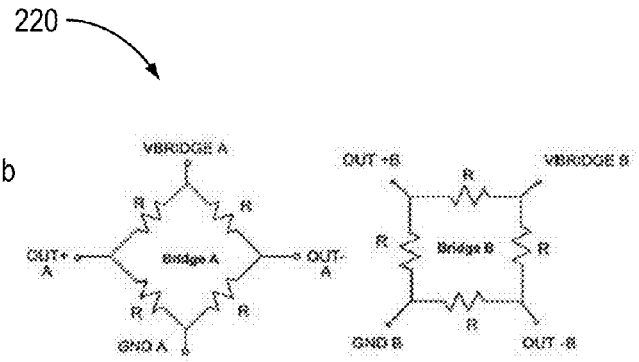
FIG. 15 is a schematic view of a sensor.

In some embodiments, as shown in FIG. 11 the magnet 222 moves substantially linearly 224 with respect to the magnetic displacement sensor 220, wherein the magnetic displacement sensor 220 is in a field-saturated mode. Further, in some embodiments, the magnet 222 moves substantially angularly 226 with respect to the magnetic displacement sensor 220. Referring to FIGS. 14 and 15, the magnetic displacement sensor 220 may be a single field-saturated mode Wheatstone bridge sense element that creates an output voltage 230, which in some embodiments includes outputs 230*a* and 230*b*, with respect to the direction of the magnetic flux passing over the sensor 220 surface, or it may be a dual saturated-mode Wheatstone bridge elements co-located to provide an extended range of angular displacements, wherein the sensor 220 creates an output voltage 230 with respect to the direction of the magnetic flux passing over the sensor surface.

Magnetic displacement sensor 220 uses a Wheatstone bridge element to measure magnetic field direction. The bridge elements change their resistance when a magnetic field is applied across the silicon die with the thin films of magneto-resistive ferrous material forming the resistive elements. The magneto-resistance is a function of $\cos 2\theta$ where $\theta$ is the angle between the applied magnetic field and the current flow direction in the thin film. When the applied magnetic field becomes moderate (50 Oerstad or larger), the magnetization of the thin films align in the same direction as the applied field; and becomes the saturation mode. In this mode, $\theta$ is the angle between the direction of the applied field and the bridge current flow, and the magneto-resistive sensor is only sensitive to the direction of the applied field (not amplitude).

Figure 13:
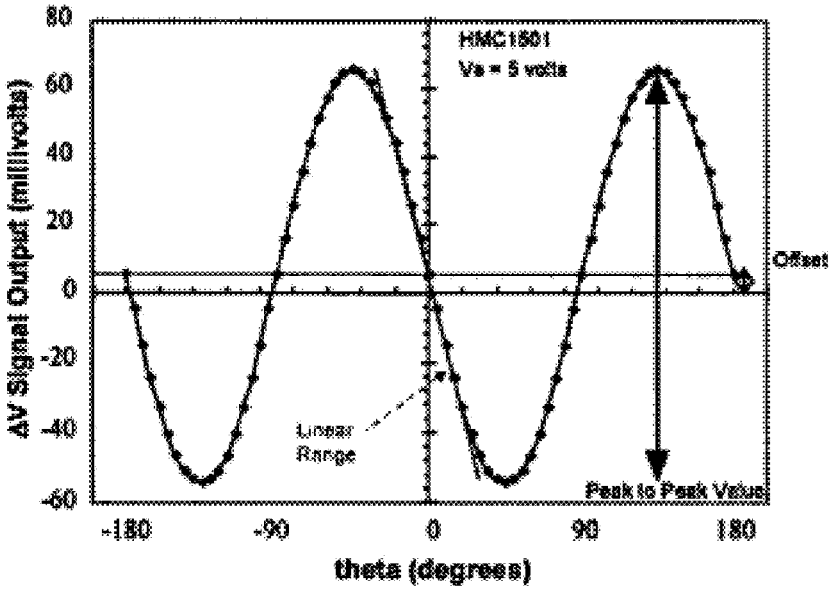
FIG. 13 is a view of a curve that shows the operation of the invention.

FIG. 13 is a graph that shows angle theta on the x-axis, and output voltage 230 on the y-axis. As shown in FIG. 13, the most linear range for the magnetic displacement sensor is in the ±45° range about the 0 degree point. This slope can be taken to full advantage for angular and linear positioning applications. The position of the magnet 222 is utilizes and the voltage output directs the change in sound characteristic. It will be understood that any and all non-linearities can be corrected by use of a lookup table stored in database 22.

The sensor is in the form of a Wheatstone bridge (see FIGS. 14 and 15). The resistance (R) of all four bridge legs is the same. The bridge power supply Vb or Vbridge, causes current to flow through the bridge elements as indicated in the figures. In some embodiments, the sensor 220 is designed to be used in field-saturation mode, with applied fields of 80 Oerstads or greater in order to function correctly.

The device further comprises a database, wherein the database stores various curves correlating to a desired music effect in a look-up table. The device also comprises a processor 16 that is adapted to compare the position of the magnet with the various curves stored in the database and applies the music effect corresponding to the position of the magnet.

According to some embodiments of the present invention, an electric instrument music control device operatively coupled to an electric instrument, the device comprises a foot pedal 10 comprising a base portion 52 and a treadle 51, wherein the treadle 51 moves with respect to the base portion 52. The device also includes a first magnetic displacement sensor 220 coupled to the base portion 52 and a first magnet 222 coupled to the treadle 51. The first magnet 222 is located in adjacent the first magnetic displacement sensor 220 to place the sensor 220 in a field-saturated mode, wherein the first magnet 222 moves with respect to the first magnetic displacement sensor 220 in response to movement of the treadle 51 with respect to the base portion 52. The device provides for a first sound characteristic of the electric instrument is modified in response to moving the first magnet 222 with respect to the first magnetic displacement sensor 220.

The embodiment may also include a second magnetic displacement sensor 220 coupled to the base portion 52 and a second magnet 222 coupled to the treadle 51. In these embodiments, the second magnet 222 is located adjacent the second magnetic displacement sensor 220 to place the sensor 220 in a field-saturated mode, wherein the second magnet 222 moves with respect to the second magnetic displacement sensor 220 in response to movement of the treadle 51 with respect to the base portion 52. Further, a second sound characteristic of the electric instrument is modified in response to moving the second magnet 222 with respect to the second magnetic displacement sensor 220.

The treadle 51, in some embodiments, is rotatable about a first axis 40 and further rotates about a second axis 44 (see FIG. 5). In this embodiment, the first magnet 222 is moveable in response to movement of the treadle 51 about the first axis 40 and the second magnet 222 is moveable in response to movement of the treadle 51 about the second axis 44.

The device may further comprise a processor that calculates the position of the first magnet 222 and the second magnet 222 with respect to the first magnetic displacement sensor 220 and the second magnetic displacement sensor 220 respectively, wherein the position of the first and second magnets 222 controls the first and second respective sound characteristic of the electric instrument. The device also comprises a database, wherein the database stores one or more than one function relating to a desired sound characteristic in a look-up table. The processor applies one or more than one stored function to the one of the first sound characteristic, second sound characteristic or combinations thereof of an electric instrument.

Figure 16:
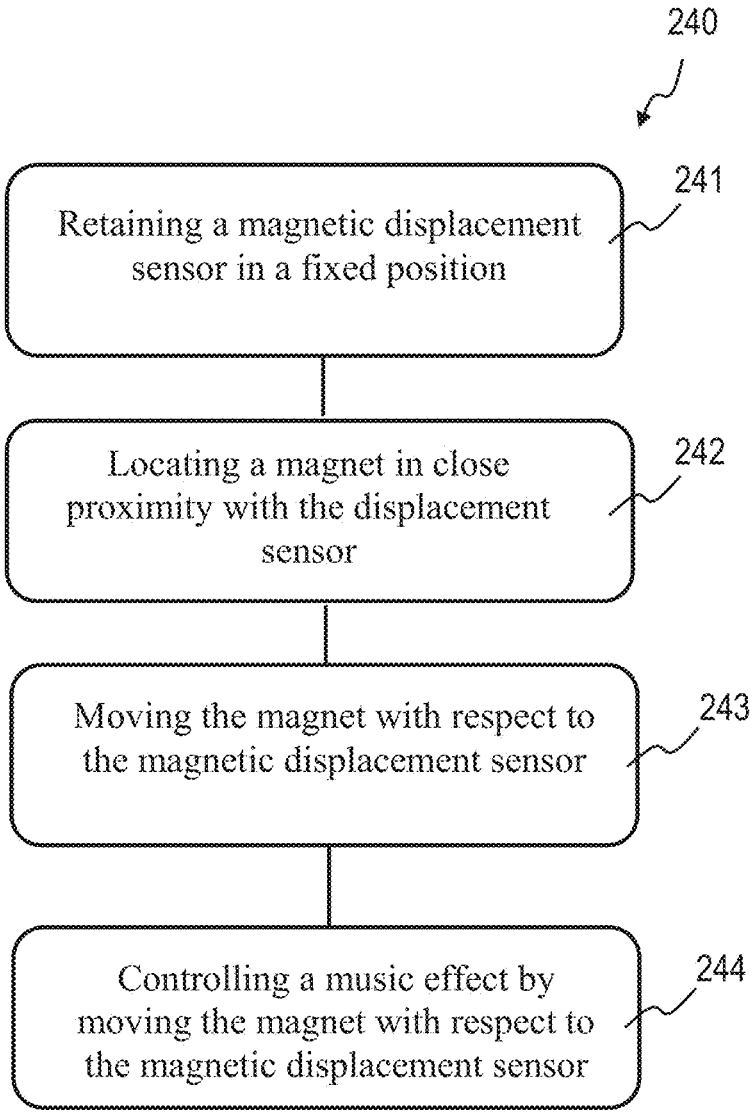
FIG. 16 is flow chart of a method of using a music control foot pedal.

FIG. 16 depicts a flow chart of a method 240 of using an electric instrument music control device. The method 240 comprises the steps of retaining a magnetic angular displacement sensor in a fixed position (Step 241); locating a magnet adjacent the magnetic angular displacement sensor to place the sensor in a field-saturated mode (Step 242); moving the magnet with respect to the magnetic angular displacement sensor (Step 243); and controlling a music effect by moving the magnet with respect to the magnetic angular displacement sensor (Step 244). In some embodiments, Step 244 of controlling the music effect further comprises determining the position of the magnet. Further in some embodiments, Step 244 of controlling the music effect further comprises changing the music effect according to the position of the magnet.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. An electric instrument music control device for use with an electric guitar, the device comprising:

a foot pedal comprising an input jack, an output jack, a base portion and a treadle, wherein the treadle moves with respect to the base portion;

an electric guitar coupled to the pedal through the input jack, wherein the electric guitar supplies a high impedance audio output through the input jack to form an audio input signal;

an amplifier coupled to the foot pedal through the output jack, wherein the output jack supplies an audio output signal to the amplifier;

a magnetic displacement sensor coupled to the base portion; and a magnet coupled to the treadle, wherein:

the magnet is located adjacent the magnetic displacement sensor to place the magnetic displacement sensor in a field-saturated mode, wherein the magnet moves with respect to the magnetic displacement sensor in response to movement of the treadle with respect to the base portion to modify the audio input signal to generate the audio output signal, and wherein the audio output signal from the field-saturated mode magnetic displacement sensor varies proportionally to the direction of the magnetic flux passing over the sensor; and a volume of the electric guitar emitted through the amplifier is modified in response to moving the magnet with respect to the magnetic displacement sensor and varying the audio output signal delivered to the amplifier from the output jack of the foot pedal.

2. The device of claim 1, wherein the magnet moves substantially linearly with respect to the magnetic displacement sensor.

3. The device of claim 1, wherein the magnet moves substantially angularly with respect to the magnetic displacement sensor.

4. The device of claim 1, wherein the magnetic displacement sensor is a field-saturated mode Wheatstone bridge sense element.

5. The device of claim 1, further comprising a database, wherein the database stores various taper functions correlating to a desired volume effect in a look-up table.

6. The device of claim 5, wherein the processor compares the position of the magnet with the taper function stored in the database and modifies the volume of the audio input signal to form the audio output signal corresponding to the position of the magnet with respect to the magnetic displacement sensor.

7. An electric instrument music control device comprising:

a foot pedal comprising an input jack, an output jack, a base portion and a treadle, wherein the treadle moves with respect to the base portion;

an electric instrument supplying audio coupled to the pedal through the input jack, wherein the electric instrument supplies high impedance audio output through the input jack to form an audio input signal;

an amplifier coupled to the foot pedal through the output jack, wherein the output jack supplies a first and second audio output signal to the amplifier;

a first magnetic displacement sensor coupled to the base portion;

a first magnet coupled to the treadle, wherein:

the first magnet is located adjacent the first magnetic displacement sensor to place the first magnetic displacement sensor in a field-saturated mode, wherein the first magnet moves with respect to the first magnetic displacement sensor in response to movement of the treadle with respect to the base portion to modify the audio input signal to generate the first audio output signal, and wherein the first audio output signal from the field-saturated mode first magnetic displacement sensor varies proportionally to the direction of the magnetic flux passing over the sensor; and a first sound characteristic of the electric guitar emitted through the amplifier is modified in response to moving the first magnet with respect to the first magnetic displacement sensor; and a second magnetic displacement sensor coupled to the base portion;

a second magnet coupled to the treadle, wherein:

the second magnet is located adjacent the second magnetic displacement sensor to place the second magnetic displacement sensor in a field-saturated mode, wherein the second magnet moves with respect to the second magnetic displacement sensor in response to movement of the treadle with respect to the base portion to modify the audio input signal to generate the second audio output signal, and the second audio output signal from the field-saturated mode second magnetic displacement sensor varies proportionally to the direction of the magnetic flux passing over the sensor; and a second sound characteristic of the electric emitted through the amplifier is modified in response to moving the second magnet with respect to the second magnetic displacement sensor.

8. The device of claim 7, wherein the treadle is rotatable about a first axis and further rotates about a second axis.

9. The device of claim 8, wherein the first magnet is moveable in response to movement of the treadle about the first axis.

10. The device of claim 9, wherein the second magnet is moveable in response to movement of the treadle about the second axis.

11. The device of claim 10, further comprising a processor that calculates the position of the first magnet and the second magnet with respect to the first magnetic displacement sensor and the second magnetic displacement sensor respectively, wherein the position of the first and second magnets controls the first and second respective sound characteristic of the electric instrument.

12. The device of claim 11, further comprising a database, wherein the database stores one or more than one function relating to a desired sound characteristic in a look-up table.

13. The device of claim 12, wherein the processor applies one or more than one stored function to the one of the first sound characteristic, second sound characteristic or combinations thereof of an electric instrument.

14. A method of using an electric instrument music control device comprising:

coupling an electric guitar having a high impedance audio output to an input jack of a foot pedal of the electric instrument music control device, wherein the high impedance audio output supplies an audio input signal through the input jack;

coupling an amplifier to an output jack of the foot pedal of the electric instrument music control device;

retaining a magnetic angular displacement sensor in a fixed position within the foot pedal;

locating a magnet adjacent the magnetic angular displacement sensor to place the magnetic angular displacement sensor in a field-saturated mode;

moving the magnet with respect to the magnetic angular displacement sensor to modify the audio input signal to generate an audio output signal from the field-saturated mode magnetic displacement sensor varying proportionally to the direction of the magnetic flux passing over the sensor; and controlling a music effect of the electric guitar emitted through the amplifier by moving the magnet with respect to the magnetic angular displacement sensor.

15. The method of claim 14, wherein controlling the music effect further comprises determining the position of the magnet.

16. The method of claim 15, wherein controlling the music effect further comprises changing the music effect according to the position of the magnet.

* * * * *